US008757248B2

(12) United States Patent
Postma et al.

(10) Patent No.: US 8,757,248 B2
(45) Date of Patent: Jun. 24, 2014

(54) HEAT EXCHANGER

(75) Inventors: Ron Postma, Voorburg (NL); Bart Van Den Berg, AS Rotterdam (NL); Robert Sakko, BL Vlaardingen (NL); Hans Constant Dikhoff, AP Eindhoven (NL)

(73) Assignee: Heatmatrix Group B.V., Vught (NL)

( * ) Notice: Subject to any disclaimer, the term of this patent is extended or adjusted under 35 U.S.C. 154(b) by 1178 days.

(21) Appl. No.: 12/668,681

(22) PCT Filed: Jul. 4, 2008

(86) PCT No.: PCT/EP2008/005484

§ 371 (c)(1),
(2), (4) Date: Apr. 27, 2010

(87) PCT Pub. No.: WO2009/007065

PCT Pub. Date: Jan. 15, 2009

(65) Prior Publication Data

US 2010/0200203 A1 Aug. 12, 2010

(30) Foreign Application Priority Data

Jul. 12, 2007 (EP) ..... 07075587

(51) Int. Cl.
*F28D 7/16* (2006.01)

(52) U.S. Cl.
USPC ..... 165/164; 165/158; 165/173; 165/178

(58) Field of Classification Search
USPC ..... 165/154, 153, 177, 178, DIG. 459, 165/DIG. 461, DIG. 462, DIG. 463, 165/DIG. 484, 158, 160, 164, 173
See application file for complete search history.

(56) References Cited

U.S. PATENT DOCUMENTS

| | | | | |
|---|---|---|---|---|
| 2,804,284 | A | 8/1957 | Otten | |
| 3,426,841 | A | 2/1969 | Johnson | |
| 4,694,898 | A | 9/1987 | Clausen | |
| 6,244,330 | B1 | 6/2001 | Eisinger et al. | |
| 2005/0051318 | A1 * | 3/2005 | Fujita et al. | 165/178 |
| 2006/0124288 | A1 * | 6/2006 | Demuth et al. | 165/175 |

FOREIGN PATENT DOCUMENTS

| | | |
|---|---|---|
| CA | 496027 | 9/1953 |
| DE | 835612 | 4/1952 |
| EP | 1686340 | 8/2006 |

(Continued)

OTHER PUBLICATIONS

Search Report dated Jan. 16, 2008 for EP07075587.

(Continued)

*Primary Examiner* — Teresa J Walberg
(74) *Attorney, Agent, or Firm* — Thomas|Horstemeyer, LLP

(57) ABSTRACT

The invention relates to a heat exchanger for heat exchange between fluids, comprising a housing having an inlet and an outlet for each fluid, the inlet and outlet for each fluid being connected to one another by a flow path, the flow path of a first fluid comprising multiple heat exchange modules comprising at least one longitudinal hollow tube, wherein the modules are arranged in a matrix configuration that comprises at least two columns of longitudinal tubes and at least two rows of longitudinal tubes, and wherein a module is provided with at least one connector for connecting to a co-operating connector of an adjacent module, such that the space enclosed between adjacent modules defines a flow path for a second fluid, parallel to the flow path for the first fluid.

15 Claims, 4 Drawing Sheets

(56) References Cited

FOREIGN PATENT DOCUMENTS

| | | |
|---|---|---|
| FR | 1259288 | 4/1961 |
| GB | 672721 | 5/1952 |
| GB | 702699 | 1/1954 |
| JP | 55-33901 | 8/1953 |
| JP | 58-26114 | 8/1956 |
| JP | 56-136995 | 10/1981 |
| JP | 61-138216 | 2/1985 |
| JP | 60-121157 | 8/1985 |
| JP | 63-36278 | 3/1988 |
| JP | 64-23092 | 1/1989 |
| JP | 1-144689 | 10/1989 |
| JP | 6-20752 | 1/1994 |
| JP | 6-180194 | 6/1994 |
| JP | 11-159993 | 6/1999 |
| JP | 11-241891 | 9/1999 |
| JP | 2004-156585 | 6/2004 |
| JP | 2006-513393 | 4/2006 |
| JP | 2006-282413 | 10/2006 |
| SU | 954786 | 8/1982 |
| WO | 2005/071339 | 8/2005 |
| WO | 2005071339 | 8/2005 |
| WO | 2006/051102 | 5/2006 |

OTHER PUBLICATIONS

PCT Search Report dated Oct. 10, 2008.

* cited by examiner

HEAT EXCHANGER

CROSS-REFERENCE TO RELATED APPLICATION

This application is the National Phase of International Application no. PCT/EP2008/005484, filed 4 Jul. 2008, which claims priority to and the benefit of EP patent application number 07075587.1, filed 12 Jul. 2007, the contents of all which are incorporated by reference herein.

FIELD OF THE INVENTION

The present invention relates to a heat exchanger for heat exchange between fluids.

BACKGROUND

U.S. Pat. No. 3,648,768 has disclosed heat exchanger elements of plastic material consisting of a plurality of parallel pipes having connecting webs maintaining the pipes transversely spaced apart, which elements can be manufactured in one piece. It is stated in this document that the elements should be designed to have an inherent static stability for all practical purposes, more specifically sufficient bending strength to allow the elements supported at their ends to bridge a distance of several meters without bending. When multiple elements of this type are combined so as to form a larger heat exchanger block, spacing members are used whose opposite sides conform to the contours of one side of each of two adjacent heat exchanger elements. These spacing members may be e.g. glued or welded to the respective elements. Mechanical connecting means such as rivets, screws and tie rods may also be used. The elements may be connected to headers by cutting out the ends of the connecting webs so that short individual pipe ends project from the remaining main body of the connecting webs. These pipe ends may be fitted into bores of the header or anchored therein using short nipples. Due to the design this known heat exchanger having a heat exchange block comprising multiple elements of this type is a cross-flow heat exchanger.

A significant disadvantage of this known device is that although the elements are said to be thin-walled, relatively thick walls are required in heat exchangers of industrial scale, thereby severely limiting heat transfer between the fluids. Furthermore, despite the fact that the elements may be manufactured in one piece, a laborious operation whether by (physico)chemical means whether by mechanical means is needed to assemble several elements into a large heat exchange block.

Furthermore a compact countercurrent heat exchanger is for example known from US 2005/0217837. In this known heat exchanger a plurality of longitudinally extending and parallel fluid carrying tubes are arranged in thermal contact with one another. According to this publication each tube has at least one bend congruent to a bend in an immediately adjacent tube. All tubes are manufactured separately and then assembled together using for example Ag based alloy for brazing. During use a first heat exchange fluid flows through any one tube in a direction opposite to a direction of a second heat exchange fluid that flows through an immediately adjacent tube. In such a way a counter-flow heat exchange relation between the first and second heat exchange fluid is achieved. From the context of the specification it is apparent that such a compact counter-flow heat exchanger is obviously intended for use in aerospace dynamic power systems. In this known device the heat exchanger tubes are made from stainless steel.

Heat exchangers made from metal as in US 2005/0217837 are subject to fouling. Furthermore corrosion of the metal from which the heat exchanger channels are made may cause problems depending on the nature of the fluids between which heat is to be exchanged. Improvement with respect to corrosion may be achieved by using more expensive, more corrosion resistant metals or alloys such as stainless steel.

U.S. Pat. No. 4,733,718 has disclosed heat exchanger bodies or heat accumulator bodies for application according to the recuperator or regenerator principles. Such a body comprises a stack of extruded hollow chamber panels made from plastic and having plane smooth outer walls and webs that join the outer walls in a single piece. It is said that the plastic must be resistant to the media which, in use, will flow through the chambers of the hollow chamber panels. The softening temperature of the plastic should be above the highest operating temperature. The advantages claimed of this known heat exchanger body made up of a stack of individual hollow chamber panels are that the construction costs and expenses are low. The examples of individual hollow chamber panels shown in this document comprise a plastic body of one row of four adjacent hollow chambers. Several of these panels can be stacked to form the heat exchanger body. The joining of these panels in the area of the front surfaces thereof can be produced by welding, gluing or mechanically e.g. using clamping elements. Interlocking elements co-operating with elevations and/or depressions in the outer surfaces of the front surfaces of the panels are preferred. Disadvantages of this known heat exchanger relate to the double wall thickness affecting heat transfer, the square cross-section being a source of sealing problems and difficulties encountered in separately feeding the chambers. Furthermore, although the single panels can be manufactured easily, assembling multiple elements into a stacked configuration is laborious. The manufacturing process of the panels may become more complicated, if interlocking parts should be present in the panels themselves.

WO 2005/071339/discloses a heat exchanger for heat exchange between oil and water. An embodiment of this known device comprises rows of interconnected modules. Each module comprises a longitudinal tube having fins and two diametrically arranged connectors allowing assembling multiple modules into a linear row of modules. A separation plate is provided as a support between rows of interconnected modules. A first fluid flows through the longitudinal tubes, while a second fluid flows in the space between the modules and the housing and/or separation plates of the heat exchanger.

It is obvious that the designs and assembling processes discussed above are complicated, cumbersome, laborious, time-consuming and therefore expensive, offering a suboptimal final product with respect to its final heat transfer properties.

SUMMARY

An object of the present invention is to eliminate one or more of these problems.

More particularly, an object is to provide a heat exchanger, preferably made from plastic material due to its favorable anti-fouling and anti-corrosion properties and despite its poor heat transfer properties, allowing an improvement of the total strength in order to keep the wall thickness low in view of heat transfer.

Another object is to provide a heat exchanger having a stable and strong configuration, wherein the stability and strength are mainly achieved by the general design and are dependent to a lesser extent from the nature of the construction materials and thickness than the general design.

Yet another object is to provide a heat exchanger, which is easy to manufacture, in particular to assemble from modular parts and to disassemble if needed.

Another object is to provide a heat exchanger having a high heat transfer area over volume ratio ($m^2/m^3$).

Yet another object is to provide an industrial scale heat exchanger allowing the use of corrosive media as heat exchanging fluids such as seawater and reducing the risk of fouling.

According to the present invention a heat exchanger for heat exchange between fluids is provided, comprising a housing having an inlet and an outlet for each fluid, the inlet and outlet for each fluid being connected to one another by a flow path, the flow path of a first fluid comprising multiple heat exchange modules comprising at least one longitudinal hollow tube, wherein the modules are arranged in a matrix configuration that comprises at least two columns of longitudinal tubes and at least two rows of longitudinal tubes, wherein a module is provided with at least one connector for connecting to a co-operating connector of an adjacent module, such that the space enclosed between adjacent modules defines a flow path for a second fluid, parallel to the flow path for the first fluid. In the heat exchanger according to the invention a plurality of modules is arranged in a housing having an inlet and an outlet for each fluid. A module comprises at least one longitudinal hollow tube. Together the tubes establish a flow path for a first fluid from the respective inlet to the co-operating outlet in fluid communication therewith. A module is also provided with at least one connector for connecting to an adjacent module that is also provided with a suitable connector co-operating with the first mentioned connector. Due to these co-operating connecting means the heat exchanger according to the invention can be manufactured easily from a plurality of modules. Furthermore easy replacement in case of malfunctioning is allowed. Advantageously each module is provided with one or more connectors, preferably integral with the longitudinal tube, for connecting to a co-operating connector of each adjacent module. In this embodiment the resulting matrix configuration is a self-supporting arrangement. In a further preferred embodiment the modules are arranged in a matrix configuration such that the outer walls of the longitudinal tubes and the connectors of two or more modules, preferably four, enclose a space extending in the direction of the longitudinal tubes of the modules. Due to the three dimensional connections between the modules in the matrix the strength and stability thereof are high. As a result the wall thickness of the longitudinal tubes can be low thereby maintaining the heat transfer properties at a favorable level, even if the modules are manufactured from a starting material having a poor heat transfer coefficient such as plastic. The co-operating connectors of different modules are partitions separating adjacent spaces forming the flow path for a second fluid. Such a flow path fluidly connects the inlet and outlet for said second fluid. As during use the same second fluid flows at different sides of the connectors under essentially the same flow conditions, these connectors do not need sealing means in the longitudinal direction. The outer walls of the longitudinal tubes form an impermeable barrier separating the first and second fluid between which heat is exchanged. Due to the design wherein a longitudinal tube for a first fluid is surrounded on all longitudinal sides by the space(s) for a second fluid a compact heat exchanger having a high heat transfer area over volume ratio ($m^2/m^3$) is obtained. Furthermore manufacturing costs may be kept at a low level compared to heat exchangers requiring a laborious method for coupling several modules.

Advantageously the modules used in the heat exchanger according to the invention are made in one piece from a plastic, preferably from a thermoplastic material, more preferably by extrusion.

Here it is to be noted that typically heat exchangers made from plastic materials are used mostly in air conditioning systems, and not so often in industry for heat exchange between process streams, wherein for example a hot (product) stream is cooled by seawater. Plastic is less sensitive to fouling and scaling, which otherwise would affect heat transfer. As the connectors and the matrix configuration attribute to the strength and stability, the wall thickness of the longitudinal tubes can be kept low, thereby allowing a reasonably high heat transfer despite the fact that the heat thermal conductivity for plastics is low compared to heat conductive materials like metals. Thus a compact design of a heat exchanger is possible. Where resistance against corrosion is less important, the heat exchanger can also be manufactured from metals, metal alloys and carbon, as these kind of materials are preferred in view of heat transfer. Due to the general design of the heat exchanger as outlined above and the resulting stability and strength the wall thickness of the longitudinal tubes can be kept low for plastic materials in view of heat transfer properties, while for expensive materials like titanium the cost price of the longitudinal tubes can be reduced because the amount of material needed is low.

A longitudinal tube is part of the flow path for a first fluid. A "space" enclosed by assembled modules provides a flow path for a second fluid. For sake of convenience, the adjective "first" will be used in this specification to indicate parts of the heat exchanger intended for a first fluid during use. Similarly, the adjective "second" will be used in this specification to indicate parts of the heat exchanger intended for a second fluid during use.

In the heat exchanger the main directions of the flows of the first and second flow are parallel to each other, preferably in opposite directions such as in a countercurrent heat exchanger having a higher overall performance than a cross-flow heat exchanger or alternatingly co-current and countercurrent as in a multipass heat exchanger.

Advantageously a module is made from a plastic material thereby reducing the risk of corrosion, as well as the occurrence of fouling. These characteristics are significant, where one or more of the fluids between which heat exchange has to take place, is aggressive such as corrosive themselves, for example, when the cooling fluid for a hot stream in a chemical plant is a liquid comprising one or more salts like seawater. The modules used in the heat exchanger according to the invention can be easily manufactured by extrusion of the (metal or plastic the latter being preferred) material in a desired length. In practice, a heat exchanger on industrial scale may have a length up to 10 meters or more. Preferably a module has a suitable length corresponding to the longitudinal dimension of the housing, thereby not requiring to mount more than one module one behind the other in the lengthwise direction of the heat exchanger. When the length of a module is limited by the manufacturing technique, a number of such modules can be arranged one behind the other in the direction of a flow path using suitable coupling means.

Compared to the heat exchangers as disclosed in the prior art discussed above, the number of welds and the like in order to assemble the plurality of modules is decreased, which makes manufacturing more easy and less expensive.

In the heat exchanger according to the invention the modules are arranged in a matrix configuration comprising at least two columns of longitudinal tubes and at least two rows of longitudinal tubes. More preferably a column and a row may comprise tens to hundreds of longitudinal tubes in view of capacity and heat transfer area.

Preferably a longitudinal tube has a circular cross-section providing a high heat transfer area over volume ratio in relation to the hydraulic diameter. In addition, the ends of circular tubes are sealed easily in similar through bores and the like of header/distributor/collector panels to be discussed herein below due to the circular shape. Furthermore extension if required can be provided by (circular) tube sections having appropriate dimensions. As to the wall thickness, the thinner the better. Long but small diameter thin-walled tubes are preferred, e.g. tubes having a wall thickness in the order of magnitude of 0.1 mm typically 0.01-1 mm, but preferably less than 0.1 mm.

Advantageously a connector substantially extends over the whole length of a module, parallel to the longitudinal axis of a module. In this way the connectors serve as supports for other modules over the full length thereby providing a stable and strong heat exchange block. Such longitudinally extending connectors can also easily be manufactured by extrusion. Preferably a module comprising at least one tube and respective connectors is made in one piece.

Preferably a module has at least one male connector and at least one female connector. A snap fit is a suitable example of co-operating male and female connectors. A rib or fin is a suitable male connector, while two spaced apart ribs or fins establish a suitable female connector. As said herein above, sealing between adjacent spaces is not required. If necessary, the outer surface of such a rib acting as a male connector may have one or more protrusions matching corresponding recesses in the inner surfaces facing each other of the ribs acting as a female connector.

In a particular preferred embodiment a module comprises one longitudinal tube and its associated connectors. Such a module can be handled relatively easily and allows easy exchange if necessary without distortion of the other stacked and connected modules.

Advantageously the longitudinal tube is provided with at least two connectors, the angle between adjacent connectors being less than 180° C., preferably four connectors at an angle of 90° C. The latter embodiment allows for a particularly stable rectangular main matrix configuration having a high heat transfer area over volume ratio ($m^2/m^3$), while the periphery may have any shape.

In an alternative embodiment a module comprises at least two longitudinal tubes connected to each other in a side-by-side configuration by an interconnecting web of material in one piece. Such a module offers the advantage of less assembling work, and is particularly suitable for a heat exchanger designed for low to moderate operating pressures. Preferably the end tubes thereof are provided with the appropriate connectors for connecting to each adjacent module, again allowing a stable and strong matrix configuration.

The heat exchanger according to the invention advantageously comprises a distributor for connecting the inlet for a fluid to the respective flow path and a collector for connecting the respective flow path to the outlet for said fluid. This means that during use a first fluid flows from a typically single first inlet through the distributor comprising a chamber in fluid connection with the first inlet to the respective first flow path. In this way the distributor distributes the first fluid stream flowing in a first direction over the longitudinal tubes of the heat exchanger. At the other end of the modules this first fluid stream is collected in a collector comprising a collecting chamber and discharged via the respective first outlet. Similarly a distributor and collector are provided for the second fluid.

Typically in a heat exchanger of the countercurrent type the inlet for a fluid will be at one end wall of the housing, while the outlet in fluid communication with this inlet is present in a side wall section near the opposite end wall of the housing. Typically the inlets for the fluids are at opposite ends of the housing.

In a heat exchanger of the multipass type the same configuration can be applied provided that suitable fluid returning means e.g. partition plates are provided in the distributor and/or collector. Such a modification of connecting one part of tube ends and/or spaces respectively to another part of tube ends and spaces leaves the basic design of the heat exchanger according to the invention intact.

In a preferred embodiment according to the invention the inlet and outlet of the first fluid flowing through the longitudinal tubes are arranged in opposite end walls, while the inlet and outlet of the second fluid flowing through the spaces surrounding the longitudinal tubes are present in the side wall(s) of the housing. This configuration allows for a favorable mounting of the modules, as sealing is less complex.

More preferably in such an embodiment a first distributor for a first fluid comprises a distributing chamber at one end of the housing defined by an end wall of the housing, a distributor panel spaced apart from said end wall and the respective side wall sections of the housing, and wherein a first collector for the first fluid comprises a collecting chamber at the opposite end of the housing defined by the opposite end wall of the housing, a collector panel spaced apart from said opposite end wall and the respective side wall sections of the housing, and wherein the distributor panel and the collector panel are provided with a plurality of through bores corresponding to the total number and positions of the tubes defining the first flow path, the longitudinal tubes extending through the through bores of the distributor panel and collector panel in fluid communication with the distributing chamber and collector chamber. In this preferred configuration the distributor and the collector for a first fluid are positioned at the opposite ends of the heat exchanger.

In a further preferred embodiment thereof a second distributor for a second fluid comprises a distributing chamber at said opposite end of the housing defined by the collector panel, the connector sections of the modules facing the collector panel and the respective side wall sections of the housing and a second collector for the second fluid comprises a collector chamber at said first end of the housing defined by the distributor panel, the connector sections of the modules facing the distributor panel and the respective side wall sections of the housing, these second distributor and second collector being in fluid communication via the space enclosed between adjacent modules defining the flow path for the second fluid. The collector and distributor for a second fluid are positioned longitudinally adjacent to the distributor and collector for the first fluid respectively, while the tubes in which during use the first fluid flows extend through the distributing and collecting chamber of the second fluid. In order to effectively separate adjacent chambers in the heat exchanger the tubes are sealed in the distributor and collector panel respectively.

Usually a collector panel supporting the ends of the modules, in particular the ends of the longitudinal tubes thereof will be present. This panel has a plurality of through bores corresponding to the total number and positions of the tubes defining the first flow path. As the cross-section of a space has a rather complicated shape compared to the preferred circular cross-section of the longitudinal tubes, it is easier to have the same kind of arrangement at the opposite end of the housing. In other words, the inlet and outlet of the first fluid are in opposite end walls of the housing, while the inlet and outlet for the second fluid are provided in the side wall sections near the respective ends of the housing. Then only in the distributor and collector of the second fluid some kind of cross-flow heat exchange will occur. However, the major heat exchange will occur in a counter flow arrangement as defined above.

If necessary, a longitudinal tube may have an extension. In a preferred embodiment thereof a longitudinal tube is provided with an extension part comprising a tube section having a rejuvenated end inserted in the open end of the longitudinal tube. The rejuvenated end provides a sealing fit inhibiting any leakage of fluids.

In another embodiment the connectors are absent or removed at one or both ends at the longitudinal tube.

The other end of the tube section advantageously extends through the through bore in the respective panel in a sealing manner. Preferably a seal such as an O ring is provided between the outer wall of the tube section and the wall part of the respective panel defining the through bore. Other types of sealing are welding and gluing.

The type of material from which the heat exchanger modules are made depends on the nature of the heat exchanging fluids as explained herein above. Metals, ceramics, carbon and plastic may be suitable starting materials, of which plastic is preferred.

As plastic material is a poor heat conductor compared to for example metals like copper, brass and stainless steel and carbon, the thickness of the walls between adjacent chambers is kept low taking into account the physical requirements that are to be met by the construction.

In order to increase the heat transfer the plastic material from which the modules are made, may comprise a heat conduction enhancing filler like carbon particles and the like. In order to increase the strength fiber-reinforced plastics may be used.

The preferred starting material from which the modules are made, is an extrudable material like plastic, for example polyethylene, polypropylene, polystyrene, polyvinylchloride and poly(meth)acrylate, fluor containing polymers like $PTFE_X$ and biopolymers. Other plastic materials allowing higher operating temperatures for example over 100° C. to about 120° C. are polycarbonate and polysulfon. Polyvinyleen oxides, polyetherimides, polyethersulfons and especially fluor containing polymers allow for even higher operating temperatures.

According to a second aspect the invention also resides in a heat exchanger module, obviously intended for assembling a heat exchanger according to the invention, said module comprising at least one longitudinal hollow tube, the module being provided with at least one connector for connecting to a co-operating connector of another module. The preferred embodiments specified above for the heat exchanger according to the invention equally apply to the module according to the invention.

BRIEF DESCRIPTION OF THE DRAWINGS

The invention will be further explained by reference to the attached drawing, wherein.

DESCRIPTION OF THE PREFERRED EMBODIMENTS

Figure 1:
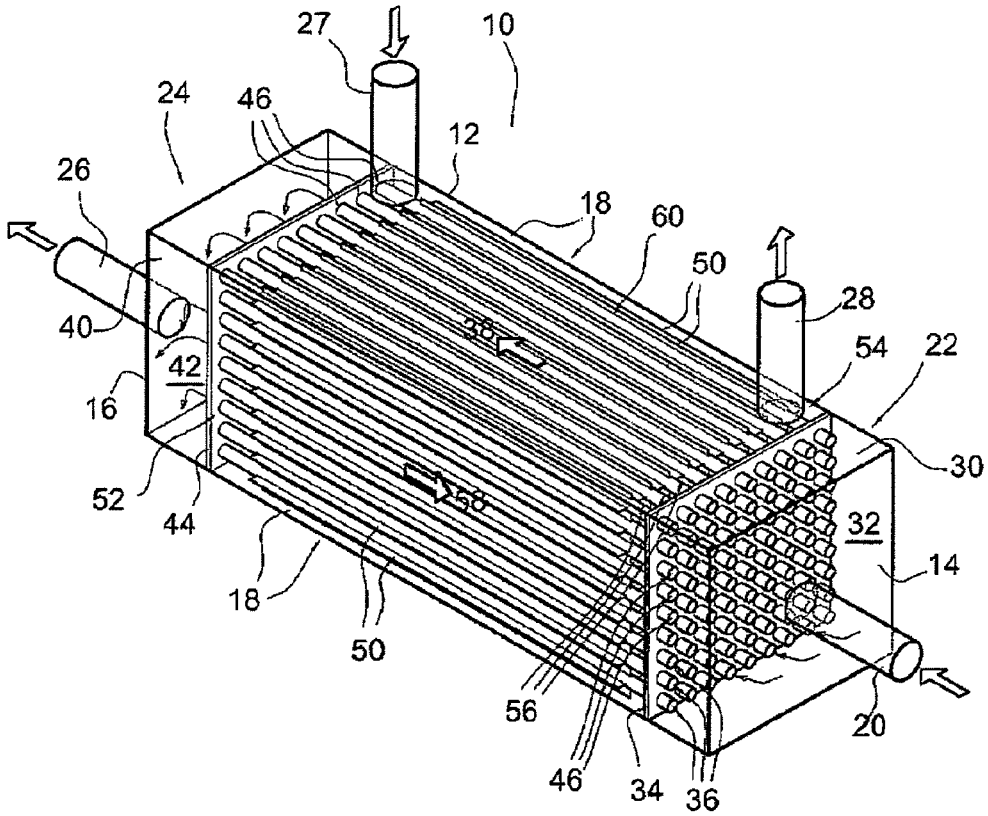
FIG. 1 is a schematic view of an embodiment of a countercurrent heat exchanger according to the invention.
Figure 2:
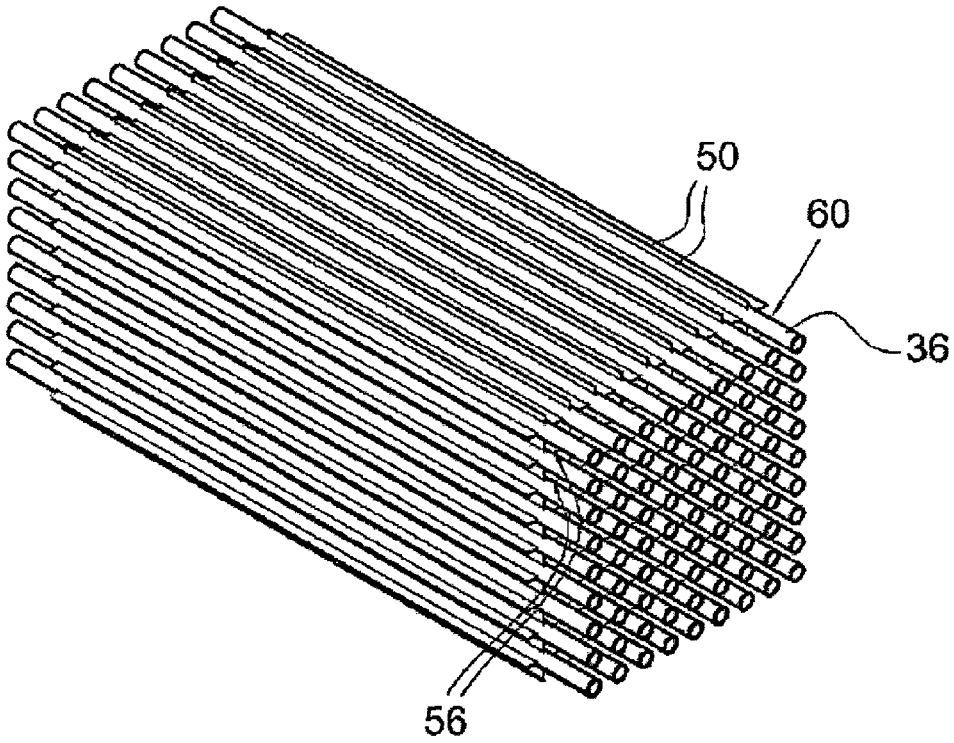
FIG. 2 shows a schematic view of a detail of the embodiment according to FIG. 1.
Figure 3:
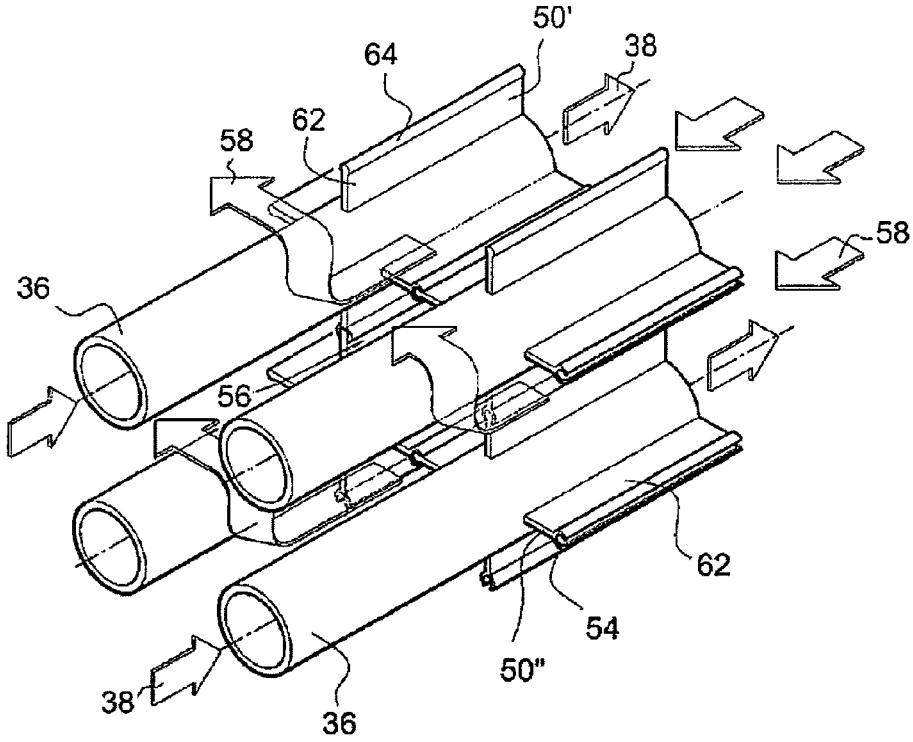
FIG. 3 schematically shows the principle flow directions of the heat exchanging fluids in the heat exchanger according to claim 1.

FIG. 1-3 show an embodiment of a countercurrent heat exchanger according to the invention. The heat exchanger is indicated in its entirety by reference numeral 10. This heat exchanger 10 comprises a housing 12 comprising respective end walls 14 and 16 and side walls 18. A first inlet 20 for a first (hot) fluid is provided in a first end wall 14 at a first end 22 of the heat exchanger 10. At the opposite end 24 a first outlet 26 is provided in the second end wall 16. A second inlet 27 for a second (cold) fluid is positioned in a side wall 18 near this opposite end 24, while the second outlet 28 for the second fluid is in a side wall 18 near the first end 22. The inlet 20 is connected to a distributor 30 comprising a distributing chamber 32 in the housing 12. This chamber 32 is delimited by the first end wall 14, the respective parts of the side walls 18 adjacent said end wall 14 and a distributor panel 34. The distributing chamber 32 divides and feeds the first fluid over and into associated longitudinal tubes 36 defining a first flow path 38. At the opposite end 24 a collector 40 comprising a collecting chamber 42 delimited by the second end wall 16, the respective parts of the side walls 18 adjacent said end wall 16 and a collector panel 44. The distributor panel 34 and collector panel 44 have through bores 46, the number and positions thereof corresponding to those of the longitudinal tubes 36. The first fluid is introduced in the heat exchanger 10 via the inlet 20 into the distributor 30. Then it flows into the open ends of the longitudinal tubes 36. The opposite open ends thereof flow out into the collector chamber 42, where the first fluid after heat exchange is collected and then discharged through outlet 26. The longitudinal tubes 36 have a modular design. In this embodiment each tube 36 having a circular cross-section is provided with four connectors 50 circumferentially spaced apart by 90°. Each connector 50 has a strip shape and extends essentially over the length of the longitudinal tube 36. At both ends of the longitudinal tube 36 the ends of connectors 50 have been removed over a certain length. Firstly, this allows the ends of a tube 36 to be inserted in the through bores 46 of the distributor panel 34 and the collector panel 44 in a sealing manner. Secondly, the length between the respective panel and the beginning (end) of a connector 50 is sufficient to define a second distributor 52 for the second fluid at the opposite end 24 and a second collector 54 at the first end. The connectors 50 of adjacent tubes 36 are connected to each other, thereby delimiting spaces 56 for the second fluid. Together these spaces 56 define a second flow path 58 for the second fluid. This second fluid is introduced via inlet 27 into the second distributor 52. Then it flows through these spaces 56 in countercurrent to the first fluid. Subsequently the second fluid is discharged from the second collector 54 via the second outlet 28. A tube 36 and its connectors 50 is a module indicated by reference numeral 60. By interconnecting these modules 60 by means of the connectors 50 a stable stack of modules is established. FIG. 2 shows the stacked modules 60 in a 9×9 matrix. In FIG. 3 the flow direction of the first fluid flowing in the tubes 36 is indicated by vertical (standing) arrows, while the flow direction of the second fluid flowing in the spaces 56 is indicated by horizontal (lying) arrows. Furthermore this FIG. 3 illustrates an embodiment of a male connector 50' comprising a longitudinal rib 62 having a rounded edge 64, which snap fits into a female connector 50" comprising a longitudinal rib 62 having a complementary cup shaped edge 54.

Figure 4:
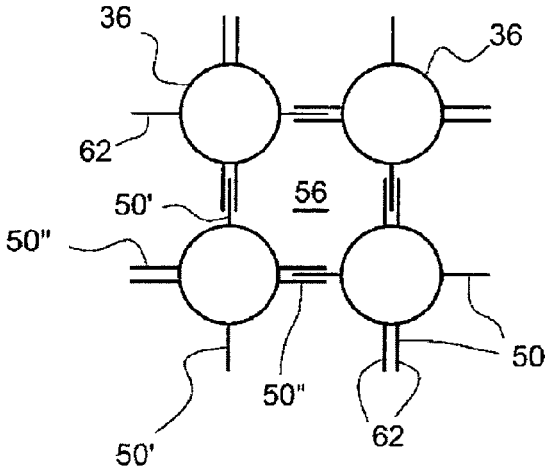
FIG. 4-6 show several embodiments of snap fits as connectors.
Figure 5:
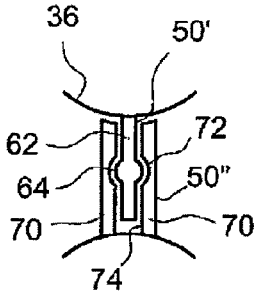
Figure 6:
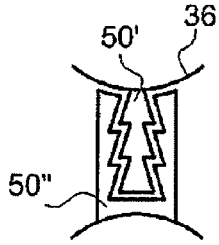

FIG. 4-6 show other examples of suitable male 50' and female connectors 50", in particular snap fit connections. In FIG. 4 the male connectors 50' are a radially extending flat rib 62 also extending in the longitudinal direction of the tube 36. A female connector 50" is comprised of a pair of parallel ribs 62 spaced apart over a width corresponding to the thickness of the rib 62 of a male connector 50'. FIG. 5 shows a rib 62 having a protrusion 64 at the middle of the height of the rib 62 as a male connector 50', while the ribs 70 of the female connector 50" have a recess 72 having a complementary shape at a corresponding position in the rib surfaces 74 facing each other. FIG. 6 shows a sawtooth configuration. Other suitable connectors would be slide fit and zip connections.

Figure 7:
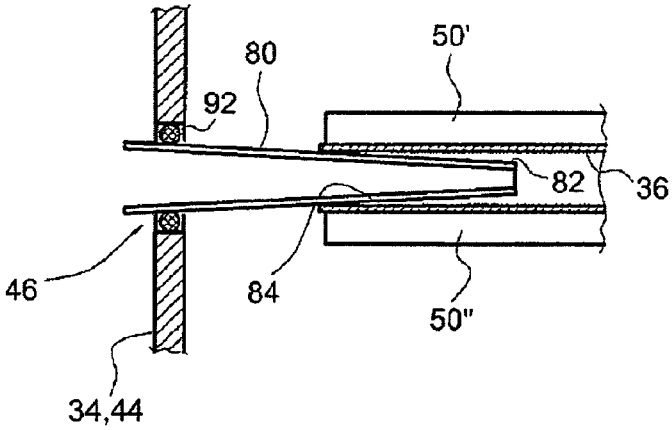
FIG. 7 shows an embodiment of a tube extension.

FIG. 7 an extension comprising a tube section 80 having a rejuvenated end 82 is inserted in the open end 84 of a longitudinal tube 36, while the other open end of the tube section 80 extends through a bore 46 in a panel 34, 44. An O ring 92 seals the distributor/collector chamber for the first fluid from the collector/distributor chamber for the second fluid.

It will be obvious to the skilled persons that many deviations and modifications from the embodiments shown in the drawings can be easily manufactured. These modifications and deviations are within the scope of the attached claims.

The invention claimed is:

1. A heat exchanger for heat exchange between fluids, the heat exchanger comprising a housing having an inlet and an outlet for each fluid, the inlet and the outlet for each fluid being connected to one another by a flow path, the flow path of a first of the fluids comprising multiple heat exchange modules comprising at least one longitudinal hollow tube, wherein the modules are arranged in a matrix configuration that comprises at least two columns of longitudinal tubes and at least two rows of longitudinal tubes, and wherein each module is provided with at least one integral connector for connecting to a co-operating connector of an adjacent module, such that the space enclosed between adjacent modules defines a flow path for a second of the fluids, parallel to the flow path for the first fluid, wherein each connector substantially extends over the whole length of the associated module parallel to longitudinal axis of a longitudinal tube thereof, and the connectors are connected to each other substantially over the whole length of the associated modules such that the matrix configuration is a self-supporting arrangement, and wherein the modules are made from plastic material, and wherein the at least one integral connector of each module comprises at least one of a male connector and a female connector, the male connectors of the modules co-operating with the female connectors of the modules by means of at least one of a snap fit or a slide fit;

further comprising a first distributor for connecting the inlet for the first fluid to the flow path for the first fluid, and a first collector for connecting the flow path for the first fluid to the outlet for the first fluid;

wherein the first distributor comprises a first distributing chamber at a first end of the housing defined by a first end wall of the housing, a first panel spaced apart from said first end wall and corresponding side wall sections of the housing, and wherein the first collector comprises a first collector chamber at a second end of the housing opposite to the first end, the first collector chamber being defined by a second end wall of the housing opposite to the first end, a second panel spaced apart from said second end wall and corresponding side wall sections of the housing, and wherein the first panel and the second panel are provided with a plurality of through bores corresponding to the total number and positions of the longitudinal tubes, the longitudinal tubes extending through the through bores of the first panel and the second panel so as to establish a fluid communication with the first distributing chamber and the first collector chamber; and further comprising a second distributor for connecting the inlet for the second fluid to the flow path for the second fluid, and a second collector for connecting the flow path for the second fluid to the outlet for the second fluid, wherein at both ends of the longitudinal tube of each module, the ends of the connectors facing the first and second panel are situated at a distance from the first and second panel, and wherein the second distributor comprises a second distributing chamber at said second end of the housing defined by the second panel, the ends of the connectors facing the second panel and being situated at a distance from the second panel, and corresponding side wall sections of the housing, and wherein the second collector comprises a second collector chamber at said first end of the housing defined by the first panel, the ends of the connectors facing the first panel and being situated at a distance from the first panel, and corresponding side wall sections of the housing, the second distributor and the second collector being in fluid communication via the spaces enclosed between adjacent modules defining the flow path for the second fluid.

2. A heat exchanger according to claim 1, wherein the modules are made for heat exchange between fluids at least one of which is a corrosion and/or fouling inducing fluid.

3. A heat exchanger according to claim 2, wherein the plastic material comprises a heat conduction enhancing filler.

4. A heat exchanger according to one claim 3, wherein the plastic material is fiber-reinforced.

5. A heat exchanger according to claim 1, wherein each module is manufactured in one piece.

6. A heat exchanger according to claim 1, wherein each longitudinal tube has a circular cross-section.

7. A heat exchanger according to claim 1, wherein each module comprises one longitudinal tube and associated connectors.

8. A heat exchanger according to claim 1, wherein each longitudinal tube is provided with at least two connectors, the angle between adjacent connectors being less than 180°, or four connectors at an angle of 90°.

9. A heat exchanger according to claim 1, wherein each module comprises at least two longitudinal tubes connected to each other in a side-by-side configuration by an interconnecting web of material in one piece.

10. A heat exchanger according to claim 9, wherein at least the longitudinal tubes of each module are provided with the connectors for connecting to another adjacent module.

11. A heat exchanger according to claim 1, wherein the heat exchanger is of the countercurrent type.

12. A heat exchanger according to claim 1, wherein the heat exchanger is of the multipass type.

13. A heat exchanger according to claim 12, wherein fluid returning means are provided in a collector and/or distributor.

14. A heat exchanger according to claim 1, wherein the longitudinal tube of each module is provided with an extension part comprising a tube section having a rejuvenated end inserted in the open end of the longitudinal tube.

15. A heat exchanger according to claim 14, wherein the other end of the tube section extends in a sealing manner through the through bore in a panel.

* * * * *